US009393472B2

(12) United States Patent
Nagi

(10) Patent No.: US 9,393,472 B2
(45) Date of Patent: Jul. 19, 2016

(54) GOLF CLUB SUPPORT

(71) Applicant: Ranjit Nagi, Stanmore (GB)

(72) Inventor: Ranjit Nagi, Stanmore (GB)

( * ) Notice: Subject to any disclaimer, the term of this patent is extended or adjusted under 35 U.S.C. 154(b) by 0 days.

(21) Appl. No.: 14/349,289

(22) PCT Filed: Oct. 3, 2012

(86) PCT No.: PCT/GB2012/052438
§ 371 (c)(1),
(2) Date: Apr. 2, 2014

(87) PCT Pub. No.: WO2013/050753
PCT Pub. Date: Apr. 11, 2013

(65) Prior Publication Data

US 2014/0235365 A1 Aug. 21, 2014

(30) Foreign Application Priority Data

Oct. 3, 2011 (GB) ..... 1117122.0
Mar. 19, 2012 (GB) ..... 1204791.6

(51) Int. Cl.
*A63B 55/10* (2006.01)

(52) U.S. Cl.
CPC ..... *A63B 55/10* (2013.01)

(58) Field of Classification Search
CPC ..... A63B 55/10
See application file for complete search history.

(56) References Cited

U.S. PATENT DOCUMENTS 5,285,990 A * 2/1994 Engel ..... 248/156
5,417,334 A * 5/1995 Wu ..... 211/70.2
5,636,754 A 6/1997 Ennis
D401,295 S * 11/1998 Young ..... D21/796
6,213,314 B1 4/2001 Beemer
6,578,719 B1 6/2003 Finn
7,172,168 B1 * 2/2007 Kallas ..... 248/530
7,568,306 B1 * 8/2009 Rice, Sr. ..... 43/21.2
D632,912 S * 2/2011 Lamb ..... D6/552
2002/0077190 A1 6/2002 Player
2003/0079766 A1 * 5/2003 Arrowood et al. ..... 135/16

(Continued)

FOREIGN PATENT DOCUMENTS

AU 8188282 1/1983
CA 2177198 11/1997

(Continued)

OTHER PUBLICATIONS

Chinese Office Action dated May 10, 2016, Chinese Application No. CN201280055287.7, pp. 1-16 (including English Translation), Jun. 17, 2016.

*Primary Examiner* — Stephen Blau
(74) *Attorney, Agent, or Firm* — MH2 Technology Law Group, LLP

(57) ABSTRACT

The present invention provides a golf club support 10 comprising an elongate shaft 12, having a first and a second end 12*a*, 12*b*; a ground engaging member 14, positioned towards said first end; a golf club rest 16 on said shaft positioned towards said second end in which said golf club rest comprises an elongate support member 20 having a first 20*a* and a second end 20*b* and a longitudinal axis Y and in which said first end 20*a* is secured to said shaft 12 and said member 20 extends substantially perpendicular thereto and by an end stop 22 at said second end 20*b* extending in at least two substantially perpendicular directions from said member. Such an arrangement allows for the support of multiple golf clubs.

22 Claims, 6 Drawing Sheets

(56) References Cited

U.S. PATENT DOCUMENTS

| | | | | |
|---|---|---|---|---|
| 2003/0102414 | A1 | 6/2003 | Smart | |
| 2003/0173474 | A1* | 9/2003 | Taylor | 248/156 |
| 2004/0198527 | A1 | 10/2004 | Hsieh | |
| 2007/0078024 | A1 | 4/2007 | Pepe | |
| 2007/0149303 | A1 | 6/2007 | Miller | |
| 2008/0182679 | A1* | 7/2008 | Trudeau | 473/286 |
| 2009/0090836 | A1* | 4/2009 | Harris | 248/530 |
| 2010/0130301 | A1 | 5/2010 | Olson | |
| 2010/0137070 | A1 | 6/2010 | Horne | |

FOREIGN PATENT DOCUMENTS

| | | | |
|---|---|---|---|
| DE | 29519969 | | 8/1996 |
| DE | 19900252 | | 1/2000 |
| FR | 2177198 | | 10/1973 |
| GB | 810415 | A | 3/1959 |
| GB | 2075832 | * | 11/1981 |

* cited by examiner

GOLF CLUB SUPPORT

CROSS-REFERENCE TO RELATED APPLICATIONS

This application is a United States national phase application under 35 U.S.C. §371 of International Patent Application No. PCT/GB2012/052438, filed on Oct. 3, 2012, which application claims the benefit of Great Britain Patent Application No. 1204791.6, filed Mar. 19, 2012 and Great Britain Patent Application No. 1117122.0, filed Oct. 3, 2011, the entire contents of which are herein incorporated in their entirety by reference. The corrected version of the PCT application republished as International Publication No. WO 2013/050753 A9 on Apr. 11, 2013.

FIELD

The present invention relates to a support for supporting elongate articles and relates particularly but not exclusively to a support suitable for supporting golf clubs in an elevated orientation relative to the ground.

BACKGROUND

Golfers generally carry a set of clubs on trolleys or buggies as they play a round of golf. On approaching every green, they have to ensure each trolley or buggy is manoeuvred into an optimum position adjoining the green. This allows the golfers a speedy exit towards the next tee area once their green-side play has been completed. By following this sequence, vital speed of play is maintained by the golfers without their trolleys or buggies causing delay during the green-side play by criss-crossing around the green to different ball/shot positions, before finally exiting the area. Consequently, golfers frequently have to manually carry more than one golf club away from their trolleys/buggies when near a green in order to complete their strokes and final putts. Generally, a golfer places his selection of unused golf clubs on the ground after having decided which one of the chosen clubs he must use to play the next stroke. The adjoining ground, which may be wet, sandy, muddy or deep rough grass, causes the grips on those clubs to get wet and dirty which may adversely affect and delay subsequent strokes. Still further, unused clubs are often left behind and lost because having had to be laid on the ground, they are not clearly visible to the golfer upon moving forward quickly onto the next stroke. This causes golfers further anxiety and delay in their efforts to play at a good speed, as expected and encouraged at all golf courses throughout the world. In the situation described above, with several clubs lying on the ground, apart from the risk of losing their cherished golf clubs, golfers of all ages can develop or aggravate back problems or knee aches in the process of frequently bending down to retrieve them.

It is known to provide some sort of support to allow the golfer to rest a selection of spare clubs in an elevated orientation when playing a shot with another of the selected clubs. One example of such a device is disclosed in U.S. Pat. No. 6,578,719 which has a large weighted base and an elongate shaft with individual hook arrangements allowing individual golf clubs to rest thereagainst. U.S. Pat. No. 5,285,990 discloses a rest in which the elongate shaft is provides with a hook or cradle arrangement at an upper end against which a golf club may be rested. The arrangement seems to require the rest to be tilted from a vertical axis in order to allow safe location of the rested club. U.S. Pat. No. 5,417,334 discloses a golf club rack which may be engaged into the ground by means of a spike but which is generally intended for carrying clubs in firmly fixed individual positions rather than just supporting them. U.S. Pat. No. 5,636,754 also discloses a golf club stand with a multi-directional planar quarter loop support which allows clubs to be rested within the loop in a substantially vertical position. The loop is provided with a restricted opening allowing clubs to be removed but it may be difficult to remove clubs when more than one is rested at a time. DE19900252 also discloses a club carrier with a ground spike and a means for firmly securing clubs at two positions along their length. The securing mechanism is primarily intended to secure the clubs during carrying and removal is not easily achieved. US2004/0198527 discloses a telescopic rod retainer used to support a golf club and includes a tight clip into which the golf club is securely retained. Removal is unlikely to be easy or intended. US2010/0130301 also discloses a golf club stand having a flat plate base and a V shaped support at an upper end. The support has no end restraints. FR2177198 discloses a golf club support and ground repair device, having a generally large rectangular planar club rest and having specifically shaped cut-outs designed for individual golf clubs. The large planar club rest cannot be carried inside a golf bag as its cutouts will interfere and entangle with other clubs therein, making them difficult to remove from the bag. If carried outside the bag, it is liable to be dislodged and lost during play as it is only clipped at one fixing point, or stolen whilst at a golfing venue as it is visible outside the golf bag. As a repairer of ball marks on a green, the radiating ribs to underside of the bottom plate will cause further damage to surface of the green beyond the ball mark, thus causing undue anxiety and delay to fellow golfers. US2003/0102414 discloses a collapsible support with legs and a generally horizontal support member which could be used as a golf club rest but contains no end restraints at all, and not easily carried inside a golf bag.

Whilst the above described supports provide at least a partial solution to the problem of supporting golf clubs as required, it has been found that they can be difficult to use or do not lend themselves to easy transportation. The present invention aims to provide a simple solution to the problem of providing an easily transportable golf club rest that can be suitably carried inside a golf bag, and can support one or more golf clubs in a convenient manner that allows easy and speedy access thereto as and when desired.

SUMMARY

Accordingly, the present invention provides a golf club support comprising: an elongate shaft, having a first and a second end; a ground engaging member, positioned towards said first end; a golf club rest on said shaft positioned towards said second end; characterised in that said golf club rest comprises an elongate support member having a first and a second end and a longitudinal axis Y and in which said first end is secured to said shaft and said member extends substantially perpendicular thereto and by an end stop at said second end extending in at least two substantially perpendicular directions from said member.

Preferably, said support member is substantially tubular and has a length greater than the width of a single golf club, thereby to allow the support of multiple clubs.

Advantageously, said end stop comprises a circular member extending in multiple directions in the same plane.

Preferably, said end stop comprises a disk.

Advantageously, the support as comprising two support members.

In a preferred arrangement the support includes a collar portion around said shaft having an inner aperture and to which said one or more support members are engaged.

Preferably, said collar portion includes a mounting aperture on a side thereof and in which the first end of said support is mounted within said aperture.

Advantageously, said aperture comprises a threaded portion and said first end includes a threaded portion for engagement with said threaded portion.

Preferably, said first end of said support includes a shaft engagement portion for engagement with said shaft once inserted within said aperture.

Advantageously, said engagement portion comprises a pointed portion for penetrating said shaft.

Preferably, said ground engaging member comprises a spike which may also be a removable spike.

Advantageously, said spike comprises a first spiked end and a second securing end having a securing portion for securing said spike to the first end of said shaft.

In one arrangement, said spike includes a threaded portion and said first end includes a corresponding threaded portion for receiving and securing said spike to said shaft in a first ground engaging position, as and when desired.

Preferably, said ground engaging portion includes an internal aperture and said spike further includes a second threaded portion for engagement with the threaded portion on the shaft when said spiked end is inserted within said aperture.

In some arrangements the spike has a rounded end.

In an alternative arrangement said ground engaging member includes a spike and an outer retractable sleeve portion surrounding said spike.

Preferably, said sleeve portion is sprung loaded by a spring member.

Advantageously, said sleeve portion includes a safety lock to prevent retraction thereof unless desired.

Said safety lock may comprise a twist lock which only allows retraction of the sleeve upon contact with the ground and twisting of the shaft relative to the ground.

In one arrangement said safety lock comprises a pin mounted in association with said elongate shaft and a slot within said sleeve for engagement with said pin, said slot including a generally circumferentially extending portion and a generally axially extending portion and wherein said sleeve is biased in a first direction away from said axially extending portion and into said circumferentially extending portion such as to prevent inadvertent dislocation of the sleeve.

Preferably, said sleeve is biased in said first direction by said spring member.

Advantageously, said safety lock comprises a movement restrictor.

In one arrangement, said spike includes one or more indents along a length thereof and said movement restrictor comprises one or more sprung loaded engagement members biased towards and into said indents.

Conveniently, said one or more engagement members may comprise ball bearings biased by one or more springs.

BRIEF DESCRIPTION OF THE DRAWINGS

The present invention will now be more particularly described in more detail, in which.

DETAILED DESCRIPTION OF THE EMBODIMENTS

Figure 1:
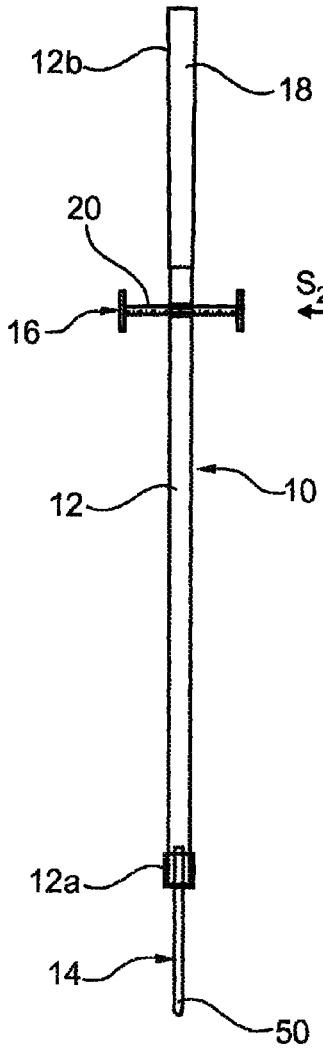
FIG. 1 is a front elevation of a support in accordance with one aspect of the present invention.
Figure 2:
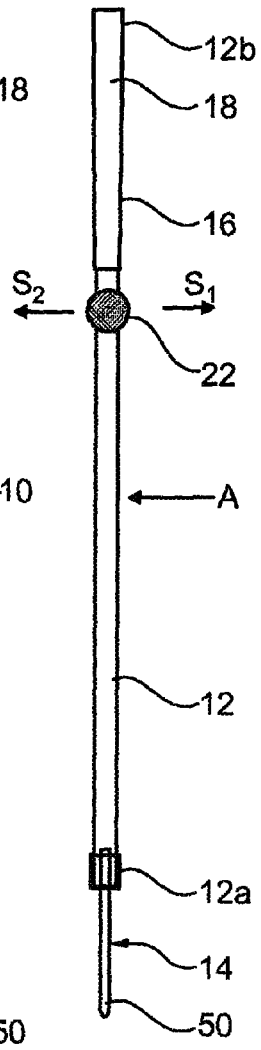
FIG. 2 is a side elevation of the support shown in FIG. 1.
Figure 3:
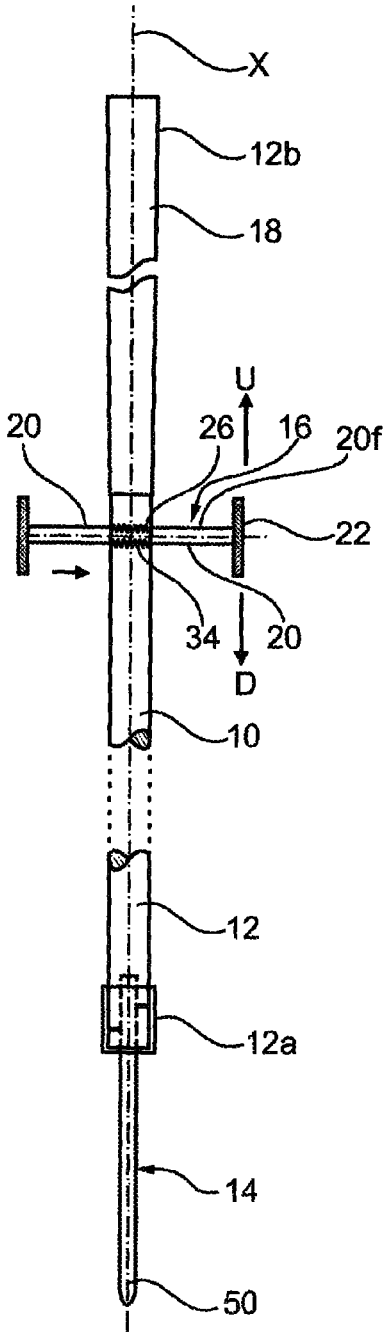
FIG. 3 is a partial cross-sectional view taken in the direction of arrow A in FIG. 2.
Figure 5:
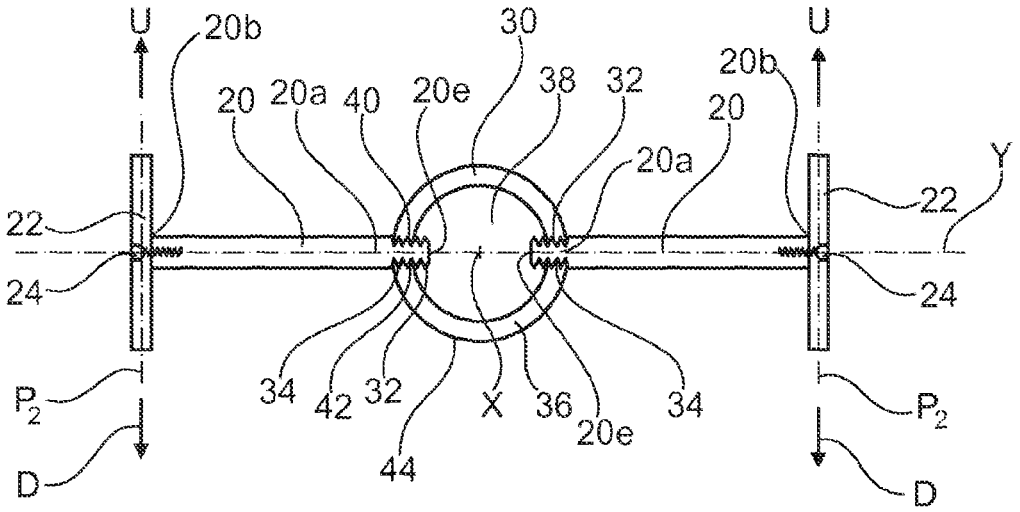
FIGS. 5 to 7 are plan views of various alternative arrangements of support.
Figure 4:
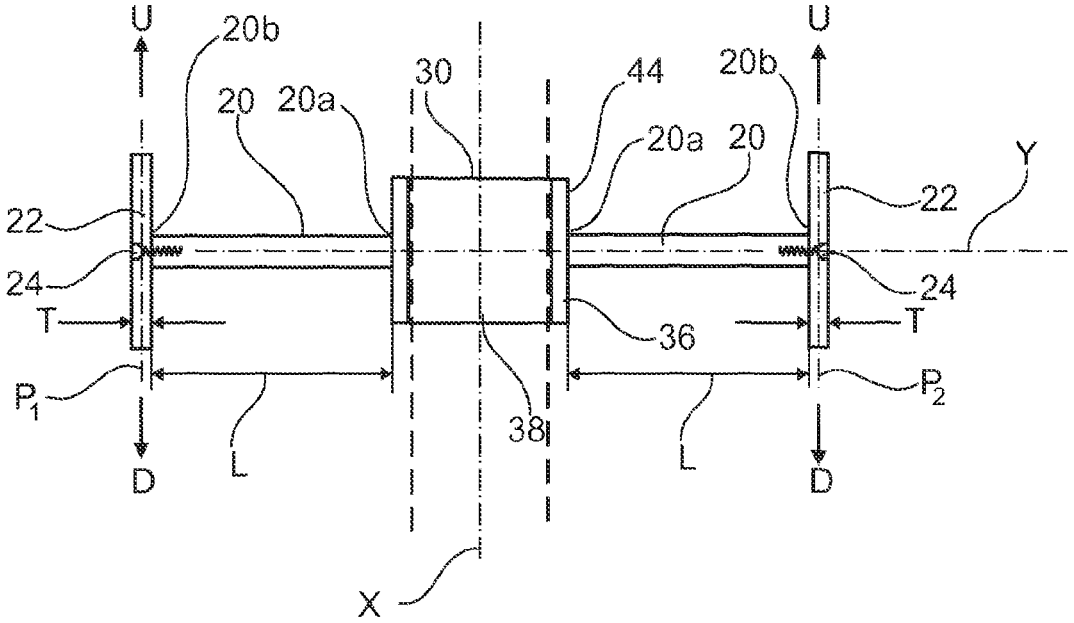
FIG. 4 is a cross-sectional view of a collar portion which may be used as an alternative to the arrangements of FIGS. 1 to 3.

Referring to the drawings in general but particularly to FIGS. 1 to 3, a golf club support 10 comprises an elongate shaft 12 having a first (upper) end 12*a* and a second end 12*b* a longitudinal axis X and a ground engaging member shown generally at 14 and positioned towards said second (bottom) end 12*b*. One or more golf club rests 16 may be provided on said shaft 12 towards said first end 12*a* but preferably below a handle portion 18 which may be provided at the upper end 12*a* and may also form the upper end itself. The rest preferably comprises an elongate support member 20 having a first end 20*a* and a second end 20*b* and extending in a longitudinal axis Y. Axis Y is preferably substantially perpendicular to axis X. The support member 20 is preferably tubular in and may be circular in cross-section but other forms may also be used. Preferably, the support member has a length L sufficient to accommodate a plurality of golf clubs at any one time such as to allow a user to place a multiplicity of spare or similar clubs together. The first end 20*a* of the one or more rests is secured to said shaft 12 in, for example, one of a number of manners described in detail later herein whilst the second end 20*b* is provided with an end-stop 22 extending in at least two substantially perpendicular directions from said member 20 and thereby forming a horizontal as well as a vertical barrier to help retain a golf club which may be rested against said support member 20. In practice, it has been found that the end-stop 22 preferably comprises a circular member extending in multiple directions in the same plane as such an arrangement is more easily able to accommodate supporting a golf club at different angles. The end-stop 22 preferably comprises a planar or disc like end-stop and may be formed as a turned component that may be fixed to the support member by a screw 24 or other such device. Whilst the above support 10 may comprise a single support 20, it preferably comprises more than one and examples of multiple arrangements are shown in FIGS. 1 to 3 and 6 and 7. Each of these arrangements may be secured to the shaft 12 in the same manner and, therefore, the following description is provided in relation to all such alternative arrangements. Securing of the supports 20 to the shaft may be by direct securing thereof into a hole 26 specifically provided within the shaft 12 itself, as best seen in FIGS. 1 to 3 or it may be by means of a collar portion 30 seen in FIGS. 4 and 5 and provided around said shaft 12. Referring briefly to FIGS. 1 to 3, a simple arrangement provides the shaft 12 with one or more holes 26 extending generally perpendicular to axis X and through the shaft 12 itself such as to provide a void into which the one or more supports 20 may be inserted and secured. Different methods of securing include the use of an adhesive, frictional engagement by means of an interference fit and the use of a screw thread 34 provided on first end 20*a* of the one or more supports. If the support extends on two opposite sides of the shaft 12, as shown in FIG. 1, one may provide a single support 20 extending right the way through the shaft 12 and may either bond it in position or may secure it by means of a screw thread 34 provided at a mid portion of the support 20 itself. In effect, a first half 20*f* is pushed through the hole until the thread engages with the hole and then the support is screwed into the hole such as to be secured therein. Whilst this arrangement provides a perfectly acceptable mounting mechanism, it has been found that the use of a collar 36 surrounding the shaft 12 may also be used. Such an arrangement has the advantage of not weakening the shaft 12 with a hole and has the further advantage of being usable as a retro-fit device on any one of a number of shafts. Still further, this arrangement may be applied to a new shaft 12 and the operable height thereof adjusted to suit a particular users desires. The collar arrangement is best seen in FIGS. 4 and 5 and from which it will be appreciated that it includes an inner aperture 38 and that one or more mounting apertures 40 are provided through the wall 44 of the collar 36 such as to receive the first end 20*a* of the support 20. Whilst the supports may be bonded within mounting apertures 40 one may also provide a screw thread 42 within the mounting aperture to correspond with the thread 34 on the support 20 such that, in operation, the support may be screwed into engagement with the collar 36 and secured thereto. Preferably, the first end 20*a* includes a shaft engaging portion 20*e* which, when the threads 34, 36 are engaged, protrudes within the inner aperture 38 such as to contact and, if pointed, preferably penetrate any shaft 12 placed therein. This arrangement facilitates the easy assembly of the supports 20 and the securing thereof to the shaft 12 whilst still allowing the arrangement to be adjusted if so desired. In addition, the arrangement allows the product to be shipped in a disassembled manner and assembled at the point of receipt, which may be by the end user. Also shown in FIG. 4 are the screws 24 mentioned above as possibly being used to secure the end stops 22. Also clear from FIGS. 4 to 7 is the generally planar arrangement of the end-stop itself 22 which extends in two or more directions in the same plane $P_1$ to $P_9$. The end-stop itself 22 is preferably relatively thin having a thickness T of less than 10 mm such as to avoid adding excess width to the support 10. In addition, and preferably, the arrangement is such that the end stop extends in a multiplicity of directions away from the support 20 both vertically upwards U, downwards D and to each side $S_1$, $S_2$ of the support axis X. Such an arrangement as illustrated by generally circular planar end-stop portions of FIGS. 4 to 7, which is a preferred arrangement of the present invention. Whilst other specific shapes may present themselves to those skilled in the art, the reader will appreciate that the above arrangement will present an end-stop portion in each of directions U, D and $S_1$, $S_2$ which will allow a golf club to be rested against the support 20 and retained by the end-stop at a large variety of angles θ, best seen and appreciated with reference to FIG. 12 and as discussed in detail later herein.

Figure 8:
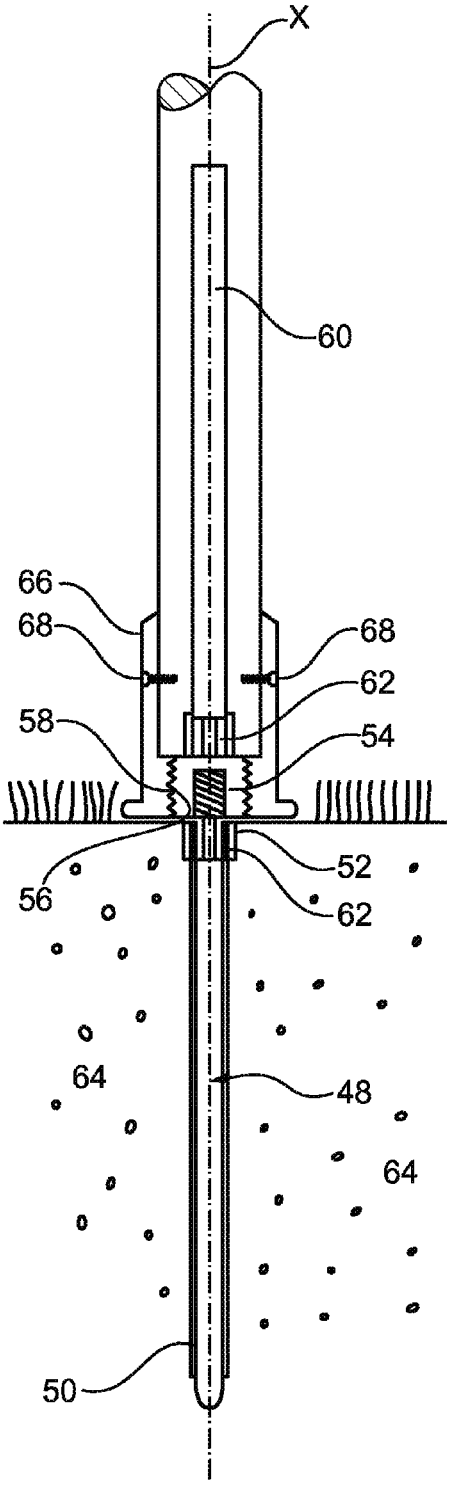
FIGS. 8 and 9 are cross-sectional views of a removable and stowable spike arrangement.
Figure 9:
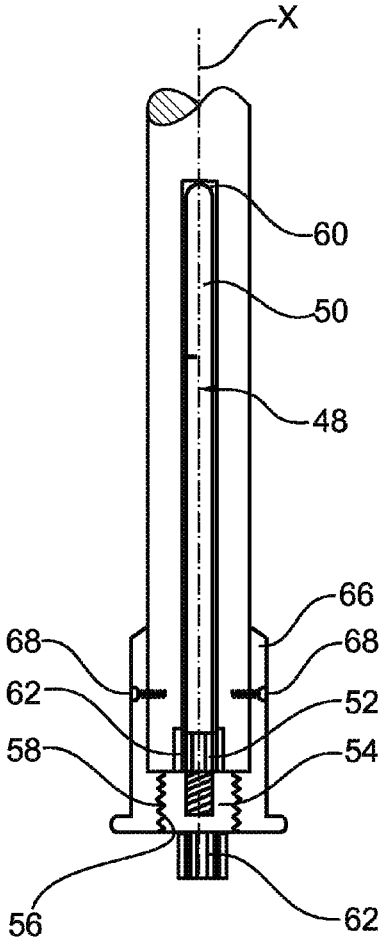

Referring to FIGS. 8 and 9 which illustrate one form of ground engaging member 14 in the form of a removable spike 48, having a ground engaging spiked end 50 and a second securing end 52 having a securing portion 54 for securing it to the shaft 12 at a first end 12*a* thereof. In the example shown, the securing portion 54 includes a first threaded portion 56 which corresponds with a matched threaded portion 58 on the first end 12*a* of the shaft 12 which receives and secures said first threaded portion 56. FIG. 8 illustrates a deployed position whilst FIG. 9 illustrates a stored position. From FIG. 8 it will be appreciated that the shaft 12 is also provided with an internal aperture 60 for receiving the spiked portion when stowed and which also accommodates a finger portion 62. The spiked end may comprise a blunted spike such as to reduce the possibility of accidental injury. The spike itself does not need to be very long as it will be pushed into the ground (FIG. 8) and the friction between it and the ground is generally sufficient to prevent easy removal. Clearly, the longer the spike the more secure the support 10 will be but it has been found that a spike of up to 4 inches is generally sufficient to secure the support 10 in most situations. An end-cap 66 may be provided on the shaft 12 and may contain the threaded portion 58 and may also be secured to the shaft by an adhesive (not shown) or screws 68. FIG. 9 illustrates the stowed arrangement in which the spiked end 50 has been removed from the ground, unscrewed from thread 58 and reversed before being inserted into the aperture 60 sufficiently to allow it to be screwed once again back into thread 58. To this end, the user may engage with finger or engagement portion 68.

Figure 10:
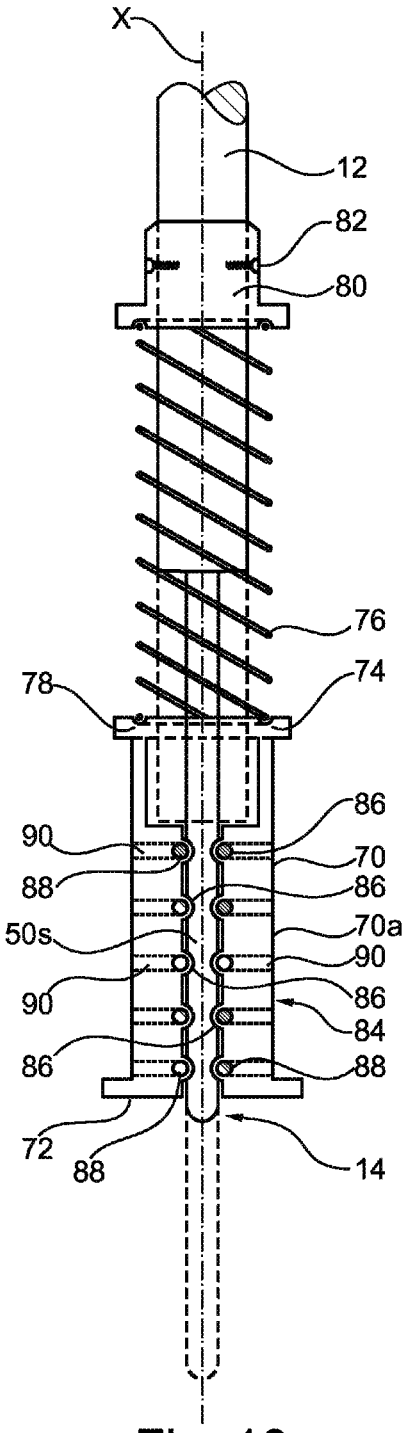
FIGS. 10 and 11 are cross-sectional views of spike arrangements with retractable safety collars.
Figure 11:
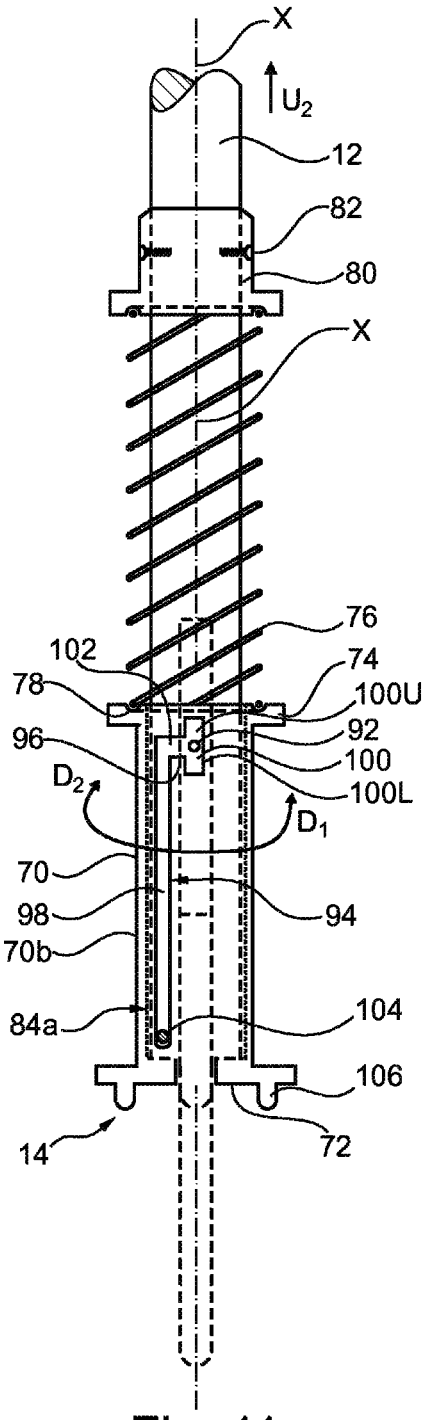

Reference is now made to FIGS. 10 and 11 which illustrate some further options for the ground engaging member 14, both of which provide a safety sleeve or shield around the spiked end 50. In FIG. 10, the first end 12*a* of the shaft 12 is provided with a fixed spike end 50*s* secured in the end 12*a* by any conventional means. A shield 70*a* surrounds the spike end 50*a* and includes at one end a ground engaging portion 72 and at another end a spring engaging portion 74. A spring 76 is provided around the shaft 12 and is in contact with engaging portion 74. This engagement may be within a groove 78 within portion 74 or may be directly on portion 74 itself. A reaction member 80 is provided on shaft 12 and between which said spring extends such as to engage therewith when compressed such as to bias said sleeve 70*a* away from the reaction member 80. The reaction member 80 may be part of the shaft 12 or may be a separate component and when a separate component may be secured to the shaft by any conventional means such as, for example, screws 82. The spiked end 50*s* in this arrangement is further provided with a safety lock 84 to prevent retraction of the sleeve unless desired. The lock itself 84 may comprise one or more indents 86 along a length of the spike which cooperate with a plurality of spring biased engagement members 88 biased towards and into said indents 86. In the example of FIG. 10 the biasing means comprises one or more springs 90 and the engagement member 88 comprise one or more ball bearings. In operation, the springs bias the balls into the indents and resist the axial displacement of the sleeve 70*a* unless desired. It will be appreciated that the provision of multiple such arrangements or the strength of the springs will affect the resistance that the sleeve 70*a* has to axial displacement and that the resistance should be selected to be sufficient to avoid inadvertent displacement whilst also not adversely affecting the safety aspect. It will also be appreciated that such an arrangement will greatly enhance the safety of the device as a positive and intended degree of pressure would be required in order to overcome the resistance to movement and the force applied would have to also overcome spring 76 before the spiked end is exposed. In normal operation, a user would place the ground engaging portion 72 in contact with the ground with the shaft 12 in a generally vertical position before pressing down firmly such as to compress spring 76 and cause the engagement members 88 to be retracted through interaction with the indents 86. Pressure is maintained until the spike portion is fully engaged in the ground (shown dotted) and then pressure can be released. The engagement members 88 will now all be located opposite a portion of the spike which does not have corresponding indents 86 and will, therefore, simply rest on the surface thereof. The spike will be retained in the ground partially due to the gripping effect associated with being forced into the ground. Removal of the support 10 from the ground simply requires one to pull it vertically upwards and then spring 76 will cause the shield 70*a* to slide back over the spiked portion. Hand assistance may help overcome any resistance to motion that the springs 90 provide.

FIG. 11 illustrates a further arrangement of safety lock 84*a* comprising a pin 92 mounted in association with the shaft 12 and a slot 94 provided within the shield 70*b* for engagement with the pin 92. The slot itself comprises a generally circumferentially extending portion 96, an axially extending portion 98 and an optional safety slot 100 of short length and extending substantially axially. The shield 70*b* is biased circumferentially to the position shown in full in FIG. 11 and this may be done by securing the spring 76 to each of the reaction member 80 and the top portion 74 of the shield itself. The shielded position of the spike is shown dotted whilst the exposed position is shown in full lines. The spring 76 biases the shield 70*b* generally downwardly as shown in FIG. 11 and thus shields the spike. To expose the spike a user must first press the ground engaging portion 72 into contact with the ground such as to create a degree of bind therewith before twisting shaft 12 in the direction of arrow $D_1$. This action will cause pin 92 to move into position 102 at a top end of axial portion 98 and then pressing down on shaft 12 will cause the shaft and spike 72 to move downwardly as the pin slides in axial slot 98 to a spike exposed pin position shown at 104 when the spike will be penetrating the ground and retained therein in the manner described with reference to FIG. 10. Removal of the support 10 simply requires the user to pull vertically upwards in the direction of arrow $U_2$ and spring 76 will act to both return the sleeve 70*b* to a position in which it covers the spike and also move it circumferentially back to the position shown at 92 in FIG. 11. It will be appreciated that safety slot 100 may be employed to prevent inadvertent exposure of the spike without first rotating the sleeve. If a user was to simply place portion 72 in contact with an object or the ground and then push downwardly without first twisting, the pin would slide downwardly into lower portion 100L of the slot 100 at which point rotation is prevented. It will also be appreciated that if safety slot 100 is extended upwards as shown at 100U then the spring 76 will also act to return the pin 92 to a safe position in which inadvertent rotation of sleeve 70*b* is also prevented. If desired, the sleeve may be provided with protrusions or pins 108 at a lower end for a more positive engagement with the ground.

Figures 6, 7:
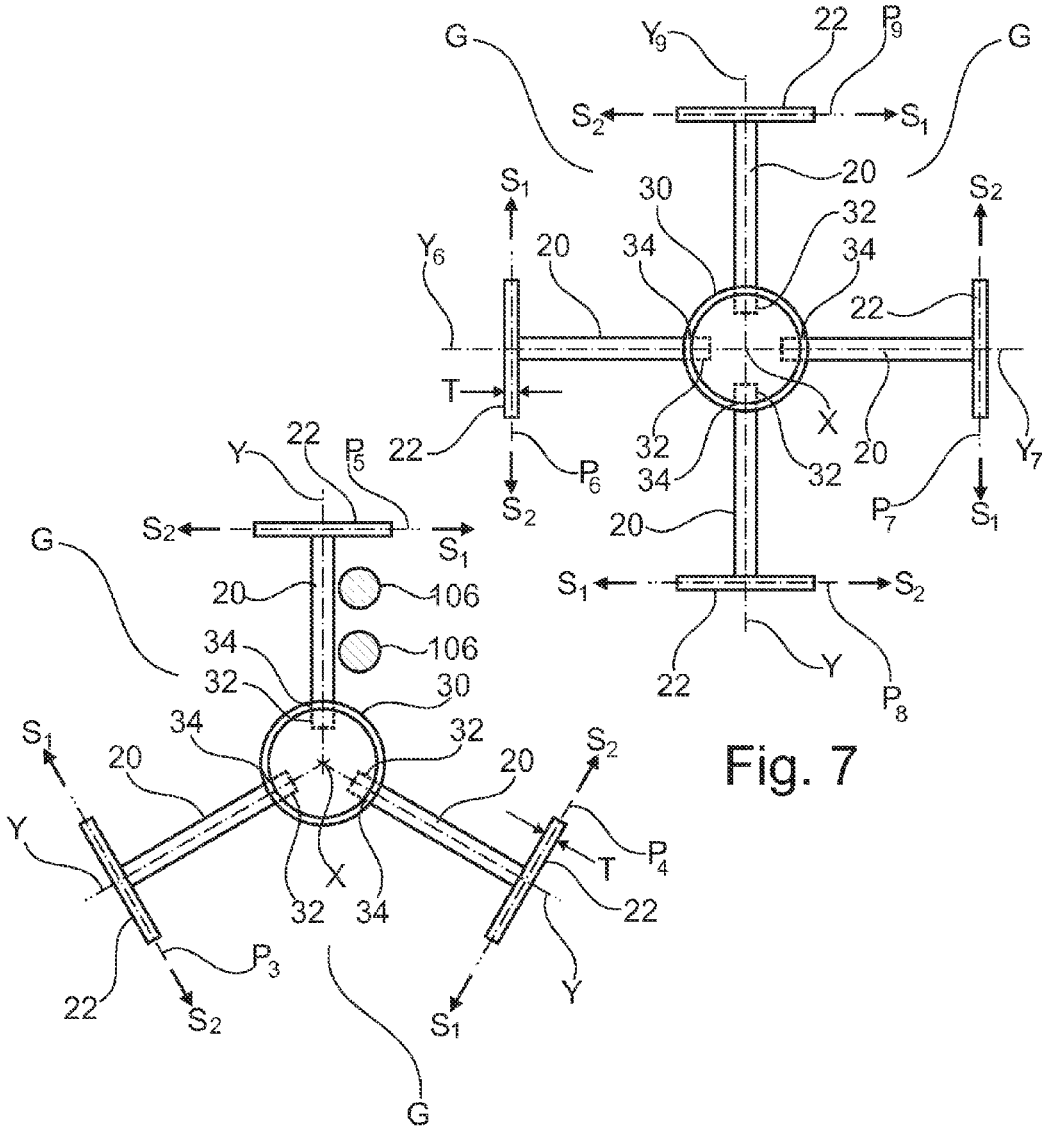
Figure 12:
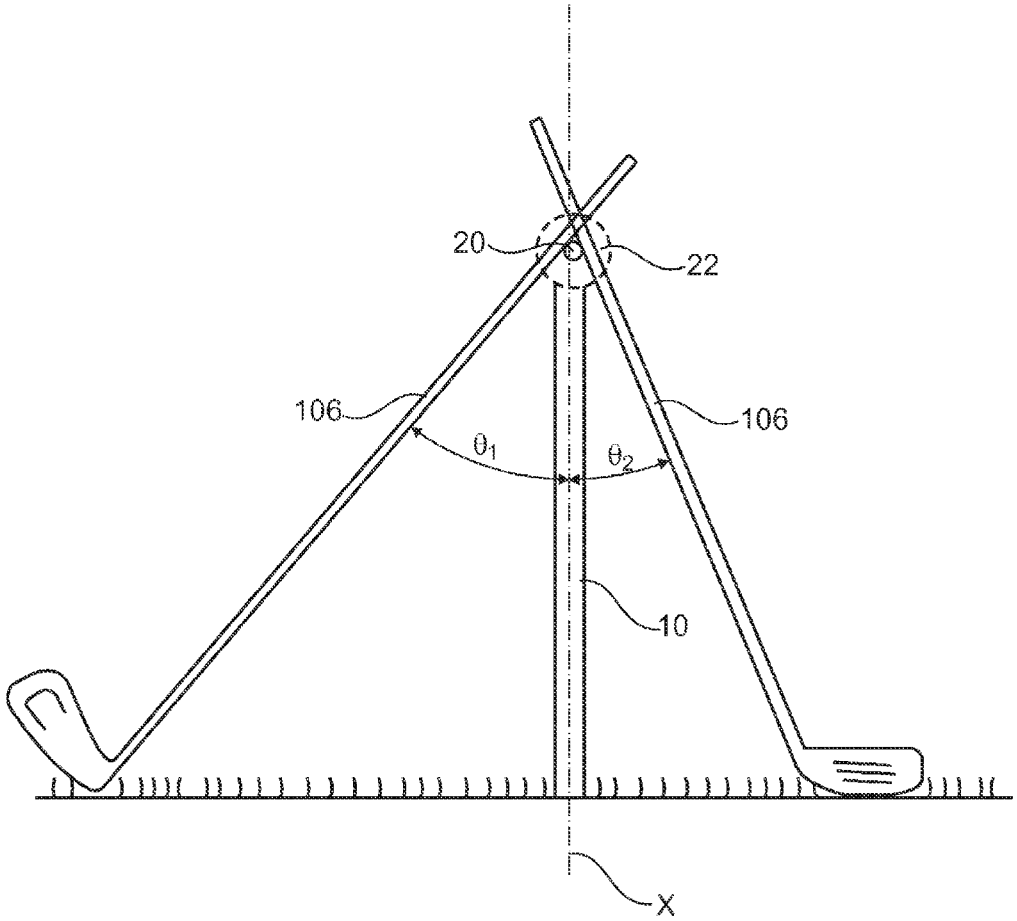
FIG. 12 illustrates the variety of angular positions of clubs that can be accommodated by the present invention.

From FIG. 12 it will be appreciated that clubs 106 may be rested against the support 20 at any one of a number of different angles $\theta_1$, $\theta_2$ without adversely affecting the security of the clubs on the support or the ease with which they may be removed. Indeed multiple clubs may be placed side by side as shown in plan view in FIG. 6. It will be appreciated that it is partially due to the multi-directional extension of end-stop that clubs can be accommodated without falling off the support. The gap G between the arrangements of FIGS. 6 and 7 are preferably selected such as to allow multiple clubs to be easily inserted and extracted from the confines of the support. In addition, it will be appreciated that the support itself 10 does not need to be vertical in use, as the rests 20 and end-stops 22 allow for clubs to be rested at any one of a number of angles.

The invention claimed is:

1. A golf club support comprising:

an elongate shaft, having a first and a second end;

a ground engaging member, positioned towards said first end; and a golf club rest on said shaft positioned towards said second end;

in which said golf club rest comprises an elongate support member having a first and a second end and a longitudinal axis Y and in which said first end is secured to said shaft and said member extends substantially perpendicular thereto and by an end stop at said second end extending in at least two substantially perpendicular directions from said member and including a collar portion around said shaft having an inner aperture and to which said one or more support members are engaged, said collar portion includes a mounting aperture on a side thereof and the first end of said support member is mounted within said aperture; and in which said first end of said support member includes a shaft engagement portion for engagement with said shaft once inserted within said aperture.

2. A golf club support as claimed in claim 1, in which said support member is substantially tubular and has a length greater than the width of a single golf club, thereby to allow the support of multiple clubs.

3. A golf club support as claimed in claim 1, in which said end stop comprises a circular member extending in multiple directions in the same plane.

4. A golf club support as claimed in claim 3, in which said end stop comprises a disk.

5. A golf club support as claimed in claim 1 and having two support members.

6. A golf club support as claimed in claim 1, in which said aperture comprises a threaded portion and said first end includes a threaded portion for engagement with said threaded portion.

7. A golf club support as claimed in claim 1, in which said engagement portion comprises a pointed portion for penetrating said shaft.

8. A golf club support as claimed in claim 1, in which said ground engaging member comprises a spike.

9. A golf club support as claimed in claim 1, in which said ground engagement member comprises a removable spike.

10. A golf club support as claimed in claim 1, in which said ground engagement member comprises a spike having a first spiked end and a second securing end having a securing portion for securing said spike to the first end of said shaft.

11. A golf club support as clamed in claim 1, in which said ground engagement member comprises a spike having a threaded portion and said first end of the elongate shaft includes a corresponding threaded portion for receiving and securing said spike to said shaft in a first ground engaging position, as and when desired.

12. A golf club support as claimed in claim 11, in which said elongate shaft includes an internal aperture and said spike is reversed and uses said spike threaded portion for engagement with the threaded portion on the shaft when said spiked end is inserted within said aperture.

13. A golf club support as claimed in claim 1, and in which said ground engagement member comprises a spike having a rounded end.

14. A golf club support as claimed in claim 1 , in which said ground engaging member further includes a spike and an outer retractable sleeve portion surrounding said spike.

15. A golf club support as claimed in claim 14, in which said sleeve portion is sprung loaded by a spring member.

16. A golf club support as claimed in claim 14, in which said sleeve portion includes a safety lock to prevent retraction thereof unless desired.

17. A golf club support as claimed in claim 16, wherein said safety lock comprises a twist lock which only allows retraction of the sleeve portion upon contact with the ground and twisting of the shaft relative to the ground.

18. A golf club support as claimed in claim 16, wherein said safety lock comprises a pin mounted in association with said elongate shaft and a slot within said sleeve portion for engagement with said pin, said slot including a generally circumferentially extending portion and a generally axially extending portion and wherein said sleeve portion is biased in a first direction away from said axially extending portion and into said circumferentially extending portion such as to prevent inadvertent dislocation of the sleeve.

19. A golf club support as claimed in claim 14, in which said sleeve portion is biased in a first direction by a spring member.

20. A golf club support as claimed in claim 14, in which said sleeve portion includes a safety lock to prevent retraction thereof unless desired and in that said safety lock comprises a movement restrictor.

21. A golf club support as claimed in claim 20, in which said spike includes one or more indents along a length thereof and said movement restrictor comprises one or more sprung loaded engagement members biased towards and into said indents.

22. A golf club support as claimed in claim 20, in which said spike includes one or more indents along a length thereof and said movement restrictor comprises one or more sprung loaded engagement members biased towards and into said indents and in that said one or more engagement members comprise ball bearings biased by one or more springs.

* * * * *